US005269656A

United States Patent [19]

Maga

[11] Patent Number: 5,269,656

[45] Date of Patent: Dec. 14, 1993

[54] HIGH DAMPING LIMP PROPELLER

[75] Inventor: Lawrence J. Maga, Fairfax, Va.

[73] Assignee: The United States of America as represented by the Secretary of the Navy, Washington, D.C.

[21] Appl. No.: 953,341

[22] Filed: Sep. 30, 1992

[51] Int. Cl.[5] ..... F04D 29/18

[52] U.S. Cl. ..... 416/189; 416/191; 416/226; 416/230; 416/240

[58] Field of Search ..... 416/132 R, 132 A, 189 R, 416/191, 224, 226, 240, 230, 241 A

[56] References Cited

U.S. PATENT DOCUMENTS

| | | | |
|---|---|---|---|
| 652,123 | 6/1900 | Lavigne | 416/191 |
| 2,426,742 | 9/1947 | Pawlowski | 416/189 |
| 2,584,663 | 2/1952 | Bensen | 416/226 |
| 3,597,108 | 8/1971 | Mercer et al. | 416/240 |
| 4,097,193 | 6/1978 | Briinsch et al. | |
| 4,370,096 | 1/1983 | Church | 416/189 |
| 4,797,066 | 1/1989 | Stromberg . | |
| 5,108,262 | 4/1992 | Crane . | |
| 5,145,320 | 9/1992 | Blake et al. | 416/224 |

FOREIGN PATENT DOCUMENTS

| | | | |
|---|---|---|---|
| 462409 | 7/1928 | Fed. Rep. of Germany | 416/226 |
| 2292878 | 6/1976 | France | 416/240 |
| 8290 | of 1911 | United Kingdom | 416/132 |
| 581956 | 10/1946 | United Kingdom | 416/230 R |

*Primary Examiner*—Edward K. Look
*Assistant Examiner*—James A. Larson
*Attorney, Agent, or Firm*—Gary G. Borda

[57] ABSTRACT

A limp propeller for underwater use with a high mechanical damping ability to absorb so-called broadband vibration noise is comprised of a fabric-like material, preferably made of braided high tensile strength material such as fiberglass or graphite fibers. The fabric is devoid of any stiffening plastic or epoxy matrix material. Rather a flexible matrix material having relatively large hysteretic losses when deformed cyclically in place of the stiffening plastic or epoxy matrix, or no matrix material at all is used in the present invention. The flexible matrix material or the complete absence of any matrix material renders the propeller blade relatively limp to flexure, thereby reducing its acoustic radiation damping or radiation efficiency.

10 Claims, 10 Drawing Sheets

HIGH DAMPING LIMP PROPELLER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

1. Field of the Invention

This invention relates to a novel propeller used for underwater purposes, in particular, a propeller having limp propeller blades or vanes.

2. Description of the Prior Art

Prior propellers are constructed of metal and, more recently, out of plastics or fiber reinforced composite plastics or "aerospace" material, and are structural in nature. Propellers made of conventional material are designed to be relatively stiff and light in order to support the applied loads. However, propellers made of such material are not particularly suitable acoustically when used for underwater purposes as they have a relatively low inherent or mechanical damping ability and relatively high surface flexural wave speeds, which translate to a higher acoustic sound radiation or propagation, i.e., the lower the inherent mechanical damping ability and the greater the surface flexural wave speed, the higher the acoustic radiation. Basically, decreasing the blade surface flexural wave speed will reduce the acoustic radiation, in the frequency range, U.S. Pat. Nos. 4,097,193; 4,797,066; and 5,108,262 disclose improved propeller blades and the like. In particular, U.S. Pat. No. 4,097,193 discloses an elastomeric damping arrangement for damping vibrations of a structural member, such as a vibration prone airfoil, particularly a helicopter rotor blade which tends to vibrate under dynamic deformations. The damping materials disclosed are silicones, various rubber compounds or polyurethane.

U.S. Pat. No. 4,797,066 discloses a propeller blade that automatically optimizes its pitch to reduce cavitation thereof. The propeller blade is flexible and is comprised of plastic materials having anisotropic properties, i.e., materials with different physical characteristics in different directions. The propeller's improved properties are achieved by having the reinforcement applied in sections, with the reinforcing elements in one section extending in the same direction, but with the reinforcing elements of one section extending in direction other than the corresponding elements of another section.

U.S. Pat. No. 5,108,262 discloses a flexible high damping propeller comprising a unitary hub having an axis of rotation and multiple blades extending radially from the hub. Each blade comprises a tip portion made of a high density material having the shape that conforms to that of the propeller blade shape and an inner portion, which is contiguous and collinear with the tip portion, of multidimensionally braided fiber preforms of reinforcing fibers such as graphite, fiberglass, kevlar, polyethylene, etc., impregnated with a highly viscoelastic matrix material such as rubber, urethane, etc. Basically, when the propeller is in a loaded state (rotating), shear stresses occur in the viscoelastic material at the interface between the viscoelastic material and the relatively stiff fibers (reinforcing fibers). This high energy dissipating mechanism causes the majority of damping. For underwater use purposes, the composites have a density close to that of water which leads to increased radiation when compared with metal. Some vibrational frequencies propagate long distances in the water. To modify these frequencies, the natural frequency of the structure is changed by adding concentrated weight to the propeller blades to change the modal shape or response.

In U.S. Pat. No. 5,108,262, the propeller blades are designed to be limp under a static load (non-rotating condition). Once the blades rotate, however, they are subject to hydrodynamic forces that produce large longitudinal, circumferential, and tangential stresses on the propeller blades.

SUMMARY OF THE INVENTION

It is an object of the present invention to produce a propeller for underwater use, with a high mechanical damping ability to absorb so-called broadband vibration noise. Another object of the invention is to reduce the stiffness and weight of the propeller blades and provide a more efficient mechanical dissipation mechanism.

The noise and vibration generated by a propeller for underwater use can be damped by using limp structured blades, as disclosed in U.S. Pat. No. 5,108,262. The objects of the present invention thus achieved by rendering the propeller blades relatively "limp" by constructing the propeller blades from flexible materials, lowering the stiffness to mass ratio and hence the surface flexural wave speed through the addition of localized masses within each blade, while increasing the damping via shear stresses occurring between the flexible fabric fibers and/or the hysteretic losses induced in a flexible matrix material as disclosed for example in U.S. Pat. No. 5,108,262, when used. The shear stresses may be increased, during propeller operation, by adding mass at the blade tips. The flexible matrix material when used in the present invention, is any viscoelastic polymeric material, i.e., a material which absorbs or dissipates vibration energy when cyclically deformed, especially in shear when induced to a vibration. Specifically, the propeller blades, which extend radially from a central rotatable hub, are constructed from a fabric-like material made of high tensile strength material such as fiberglass or graphite fibers. The fabric is devoid of any stiffening plastic or epoxy matrix material usually used in so called "fiber glass" or "GRP" structures. Rather a flexible matrix material having relatively large hysteretic losses when deformed cyclically in place of the stiffening plastic or epoxy matrix, or no matrix material at all is used in the present invention.

The flexible matrix material or the complete absence of any matrix material renders the propeller blade relatively limp to flexure, thereby reducing its acoustic radiation efficiency or propagation efficiency. In order to decrease the stiffness to mass ratio and hence, reduce the radiation efficiency even further, localized masses of high density fibers or solid inserts are incorporated into the propeller blades at regions of the blade where mechanical excitation (surface pressure fluctuation) intensity is greatest and most well coupled to the vibration field. High density fibers or solid inserts of dense materials such as tungsten and uranium are preferably used, although any high dense material will suffice (the greater the density, the greater the effectiveness). The propeller blades made according to the present invention reduce acoustic radiation in the frequency ranges of radiation loss mechanisms in comparison with that of identical light, rigid propellers.

During propeller rotation, the individual blades are subject to hydrodynamic and centrifugal forces that produce longitudinal, radial, and tangential stresses which induce relative motion between the fibers of the flexible fabric material. These stresses may be increased by providing additional mass at the blade tips. The relative motion between the fibers of the flexible fabric material results in a higher inherent damping ability i) because of hysteretic losses in the flexible matrix material, when used and/or ii) because of shear stress friction occurring at the interface between the individual fibers of the flexible fabric when the viscoelastic material is not used. This increased inherent damping would reduce the acoustic radiation from the propeller in frequency regimes in which the acoustic radiation is controlled by the inherent damping.

Moreover, it is preferable to increase the damping ability by coating these limp blades with a flexible rubber-like viscoelastic material to provide the necessary hydrodynamic fairing or smoothness to the otherwise relatively rough texture of the fabric and to provide protection of the fibers from mechanical damage such as from the impact of objects or from cavitation and also to reduce the likelihood of cavitation.

In order for the limp fabric-like blades to bear a flow induced applied load, and thus produce thrust during propeller operation (rotation), the blades must develop both an appropriate airfoil shaped cross-section and a sufficient centrifugal force to extend the blades in the radial direction so that an operational configuration of the blade (e.g., operational span, pitch, and skew) is maintained. This can be facilitated either by adding mass at the outer radial tip of each blade or by providing additional structure, such as support spars as hereinafter more fully described, within each blade. In one embodiment, the outer tips of the blades are attached to a continuous circular ring, while in an alternative embodiment the outer tips of the blades are attached to circular ring segments as hereinafter more fully described. The outer tips of the blades are attached to the ring or ring in a fashion similar to the way bicycle spokes are attached to the rim of a bicycle wheel. Similar to the spokes of the bicycle wheel, which are attached through the holes in the rim, the fabric can be woven, sewn or attached through the holes formed in the ring. The fabric can also be attached to some termination which in turn is attached to the rim via bolts or clamps.

The fabric is configured and attached to the hub and the ring in such a fashion that under load the fabric would produce the necessary camber and lift in a manner similar to the way a sail on a sailboat produces lift to propel the sailboat. Specifically, even though an unfurled sail on a sailboat appears to be limp and shapeless when it bears no load (no wind), it nevertheless acquires the shape of a lifting surface (an airfoil shape) when properly subjected to a load because of the shape of its cut, the manner in which it is sewn together, its weave and its manner of support when it is unfurled. Similarly, the limp blades of the present invention acquire the appropriate, requisite airfoil shape through the shaped of the cut of the fabric, the weave, and the relatively rigid support at the ring and the hub. Thus, the present invention consists of: (1) a central hub having an axis of rotation and adapted for mounting to a rotatable shaft; (2) a plurality circumferentially spaced apart flexible propeller blades extending radially from the central hub; (3) a flexible fabric of high tensile strength material that forms the outer blade structure, either along or in combination with a viscoelastic material (used as both a flexible matrix material and/or a coating material), wherein the flexible fabric and the viscoelastic material act to increase the inherent mechanical damping characteristics of the blade and thus damp flow induced acoustic radiation; and (4) means to support each blade during operation of the propeller to maintain an operational configuration under flow induced applied loads. In one embodiment, the means to support each blade comprise a circular support ring connected to the outer tip of the blades. In an alternative embodiment, the means to support each blade comprise one or more radially extending support spars within each blade, either alone or in combination with one or more flat inner supports spaced radially from the central hub and extending between the leading and trailing edges of each blade. In another alternative embodiment, the means to support each blade comprise the combination of a circular support ring, one or more support spars, and one or more flat inner supports. In yet another alternative embodiment, the means to support each blade comprise a combination of circular support ring and the incorporation of localized masses within each blade to decrease the local stiffness to mass ratio in blade regions where excitation due to flow past the propeller is greatest. In still a further embodiment, he means to support each blade comprise a plurality of ring segments, one connected to the outer tip of each blade.

DETAILED DESCRIPTION OF THE PREFERRED EMBODIMENTS

Figure 1:
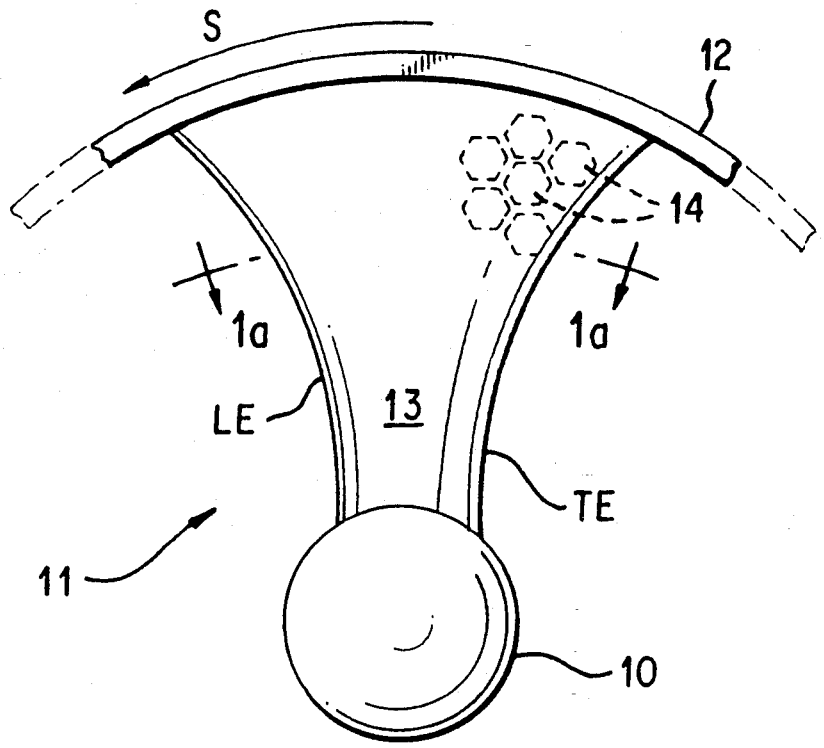
FIG. 1 is an elevational view of the first embodiment of the propeller according to the present invention, in which a limp fabric with high density fiber or localized masses is attached to a hub and a support ring.

The present invention has been described and illustrated in terms of six specific embodiments. Same or equivalent elements of the embodiments illustrated in the drawings have been identified with same reference numerals.

The embodiments described herein have been contemplated for purposes of illustrating the principles of the present invention. Accordingly, the present invention is not to be limited solely to the exact configuration and construction as illustrated and set fort herein.

FIRST EMBODIMENT

Figure 1A:
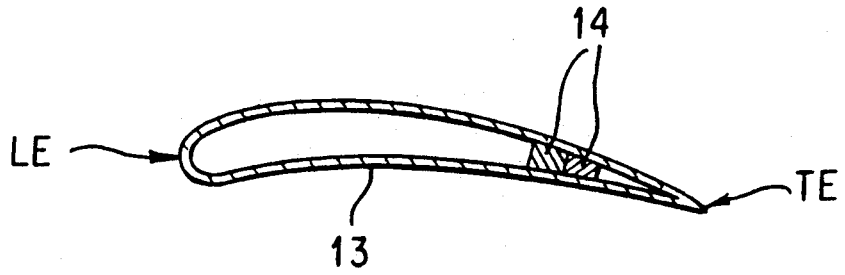
FIG. 1*a* is a cross-sectional view taken along line 1*a*—1*a* FIG. 1, showing the cross-section of the propeller blade.

A propeller according to the first embodiment of the present invention, as illustrated in FIGS. 1 and 1*a*, comprises a central hub 10 having an axis of rotation and adapted for mounting on a conventional rotatable shaft or the like in a conventional manner. The propeller rotates in the direction shown by the arrow S. A plurality of propeller blades 11 (only one shown) extend radially from the hub and the outer most tip section of each blade is attached to a circular support ring 12 which is substantially concentrically situated with respect to the hub when the propeller is rotating. The support ring can be formed of any relatively stiff material such as fiberglass, fiber reinforced plastic, composites, steel, brass, etc. The ring supports and bears the propeller blade in a fashion similar to the way bicycle spokes are attached to the rim and the hub of a bicycle wheel. That is, the ring 12 is akin to the bicycle rim.

Each propeller blade 11 has a leading edge LE and a trailing edge TE, as better illustrated in FIG. 1*a*. Each propeller blade is constructed from a conventional fabric-like material 13 made of braided high tensile strength material such as fiberglass or graphite fibers. The fabric, however, is devoid of any stiffening plastic or epoxy matrix material. The complete absence of any matrix material renders the propeller blade relatively limp to flexure. In the first embodiment, high density fibers or solid inserts of localized masses 14, having a hexagonal-shaped cross-section, preferably of tungsten and/or uranium , although any relatively high density material can be used, are situated within each blade to decrease the stiffness to mass ratio and hence, reduce the acoustic radiation efficiency even further. The high density fibers and/or localized masses are situated in regions of the blade where the mechanical excitation (surface pressure fluctuations) intensity is greatest and most well coupled to the vibration field, i.e., where the mechanical admittance of the sail-blade under load is greatest, the mechanical excitation from the flow over the blade is greatest and/or where the spatial extent of the fluid excitation best matches the vibration field of the blade. In general, that region is located in the trailing edge region of the sail-blade and the tip region of the blade, as shown in more detail in FIG. 1*b*.

Figure 7:
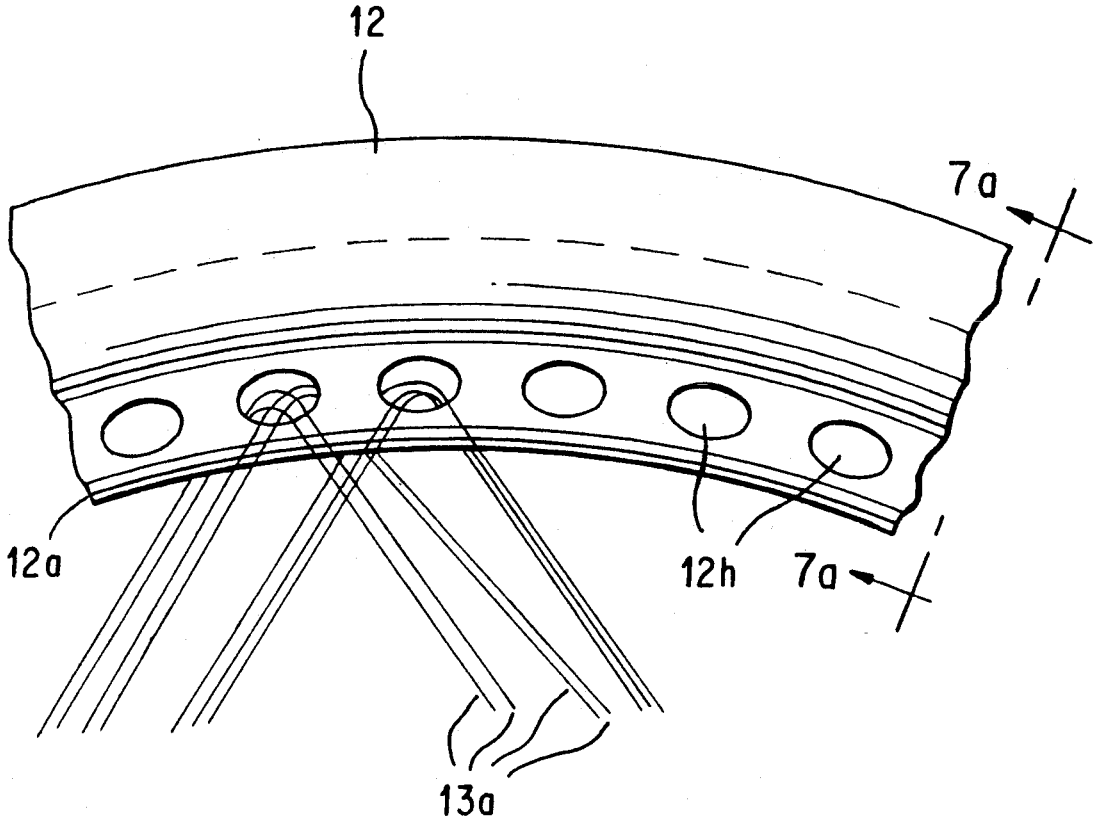
FIG. 7 shows a detailed view of one manner in which the fabric is attached to the ring.
Figure 7A:
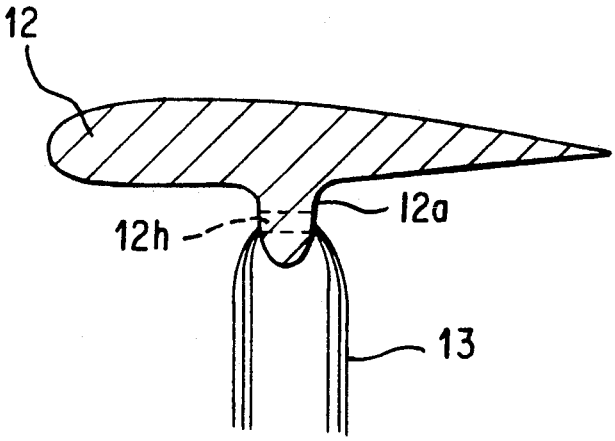
FIG. 7*a* is a cross-sectional view taken along line 7*a*--7*a* of FIG. 7, showing the cross-section of the blade and the ring.
Figure 8:
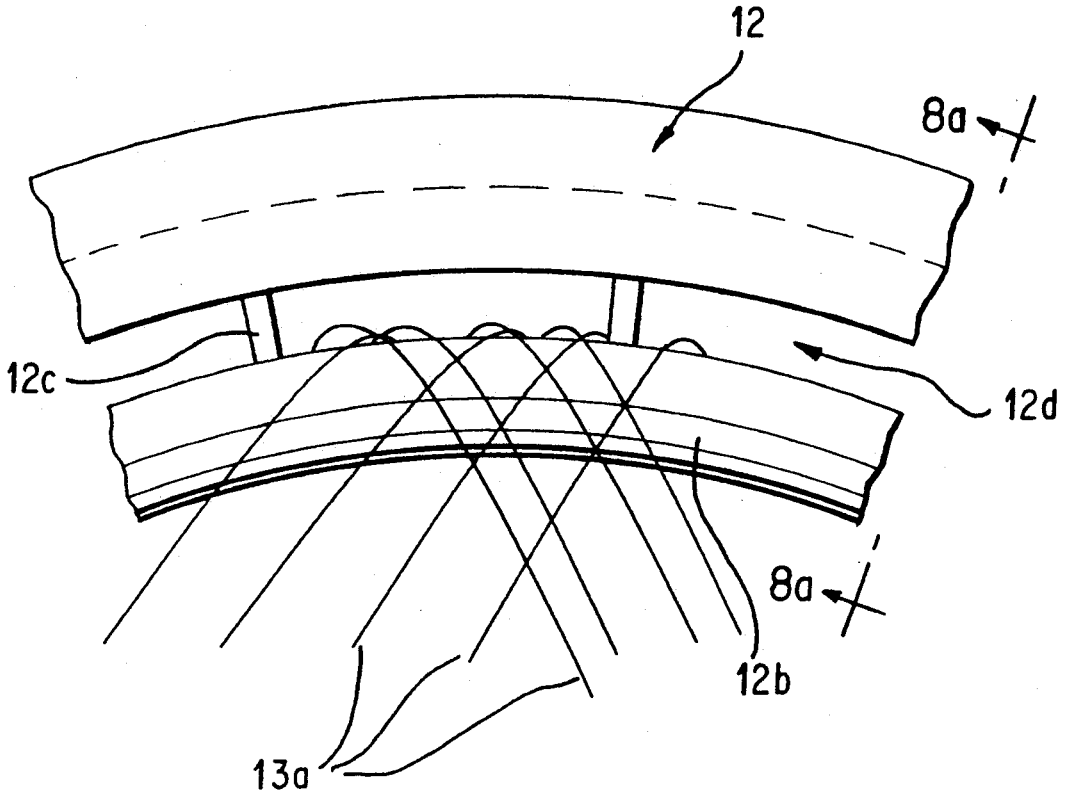
FIG. 8 shows a detailed view of an alternative manner in which the fabric is attached to the ring.
Figure 8A:
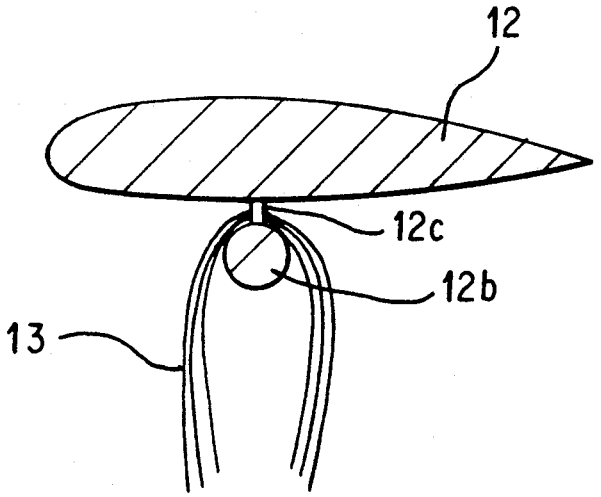
FIG. 8*a* is a cross-sectional view taken along line 8*a*—8*a* of FIG. 8, showing the cross-section of the blade and the ring.

As previously discussed, the fabric is configured and attached to the hub and the ring in such a fashion that under load the fabric produces the necessary camber and lift in a manner similar to the way a sail on a sailboat produces lift to propel the sailboat. Any number of ways can be contemplated to provide a spacing in which the fabric can be attached to the ring. FIGS. 7, 7*a* and 8, 8*a* show two different ways in which the fabric can be attached to the ring. In the embodiment of FIG. 7 and 7*a*, the ring 12 is formed with an extension ring 12*a* having a plurality of holes 12*h* formed therein. Bundles of fibers 13*a* which form the fabric 13 are weaved or passed through the holes and/or are attached to the holes. FIG. 7*a* shows the cross-section of FIG. 7 showing the cross-section of the ring and the fabric blade 11. In the embodiment of FIG. 8, an inner ring 12*b* is attached to the ring 12 at its inside perimeter using conventional fasteners such as bolts, screws with spacers 12*c*. Alternatively, the spacers could be bonded or welded to the ring. A relatively small spacing 12*d* is formed between the inner perimeter of the ring 12 and the outside perimeter of the inner ring 12*b*. Bundles of fibers 13*a* which form the fabric 13 are weaved or passed through the spacing and/or are attached to the inner ring. FIG. 8*a* shows the cross-section of the ring 12 and the inner ring 12*b*.

The propeller blades made according to the present invention reduces acoustic radiation in the frequency ranges of radiation loss mechanisms in comparison with identical light, rigid propellers. Specifically, the relative motion between the fibers of the flexible fabric material results in higher inherent damping because of frictional losses between the individual fibers. This increased inherent damping would reduce the acoustic radiation from the propeller.

Moreover, it is preferable to coat the outer exposed surface of the fabric 13 with an additional flexible rubber-like viscoelastic material to provide the necessary hydrodynamic fairing or smoothness to the otherwise relatively rough texture of the fabric and to provide protection of the fibers from mechanical damage such as from the impact of objects or from cavitation. Note that the coating can serve as the impregnated viscoelastic material or an additional coating on the outer surface. Moreover, the fabric need not be waterproof. That is, water may communicate with the interior of the limp blade. If waterproofing is desired, however, the viscoelastic coating may serve as a waterproofing material.

SECOND EMBODIMENT

Figure 2:
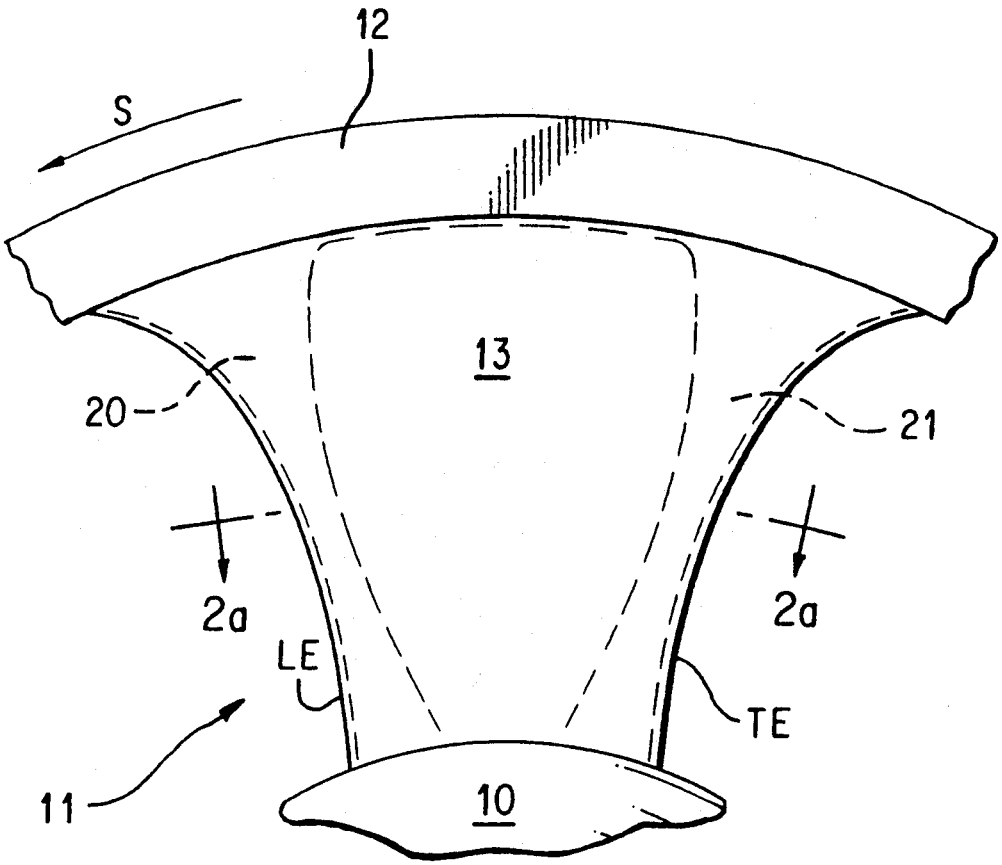
FIG. 2 is an elevational view of the second embodiment of the propeller according the present invention, in which a limp fabric is stretched between and wrapped around a leading edge spar and a trailing edge spar.

The second embodiment according to the present invention, as illustrated in FIG. 2, is similar to the first embodiment, in that each of the plurality of the propeller blades is constructed from the same limp fabric 13. However, in the second embodiment, the fabric, without any high density fibers or localized mass having hexagonal shaped cross-sections formed at the trailing edge of the blade as in the first embodiment, is stretched between and wraps around a leading edge spar 20 and a trailing edge spar 21. Each spar is made from any relatively stiff non-conducting structural material such as fiber reinforced plastics. However, in instances where the spar is made to conduct electricity, it should be made of the same material as the hub 10 and the ring 12 to prevent electrolytic damage if used in sea or salt water. Each of the spars 20, 21 (shown in phantom in FIG. 2) radially extends from the hub 10 to the support ring 12. The leading edge spar 20 protects the leading edge portion LE of the blade from impact damage while the trailing edge spar increases the local area mass density at the trailing edge. The spars are also used for the purpose of strengthening the outer support ring. In this embodiment, the support ring need not be a continuous circular ring. Since the spars support the ring, the ring can be segmented at the trailing and the leading edges of the propeller blade tip. In this instance, there will be a plurality of ring segments substantially identical to the ring segment 12*a* of the fourth embodiment rather than a full circular ring. Moreover, the fabric may be attached to the ring as shown in FIGS. 7 and 8. This embodiment may optionally include a viscoelastic material as the flexible matrix material and/or a coating material, as the operational requirements dictate.

Figure 2A:
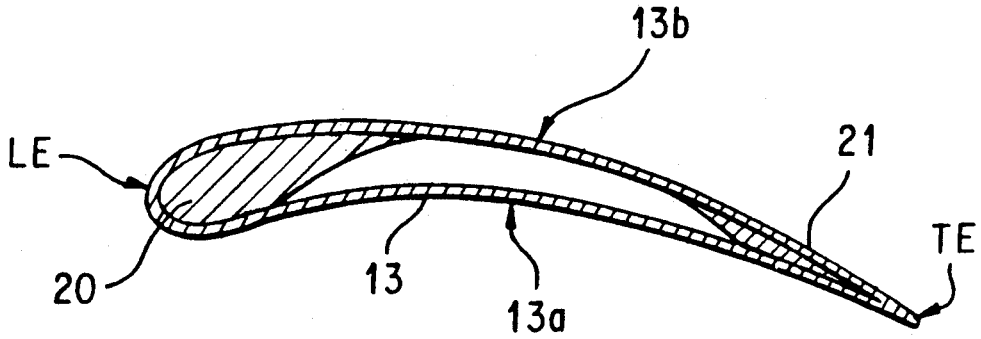
FIG. 2*a* is a cross-sectional view taken along line 2*a*—2*a* of FIG. 2, showing the cross-section of the propeller blade.

FIG. 2*a* illustrates a cross-section of the propeller blade taken along the line 2*a*—2*a*. FIG. 2*a* depicts the shape of the blade during rotation of the propeller. The concave side 13*a* of the fabric surface is the pressure side and the convex side 13*b* of the fabric surface is the suction side.

THIRD EMBODIMENT

Figure 3:
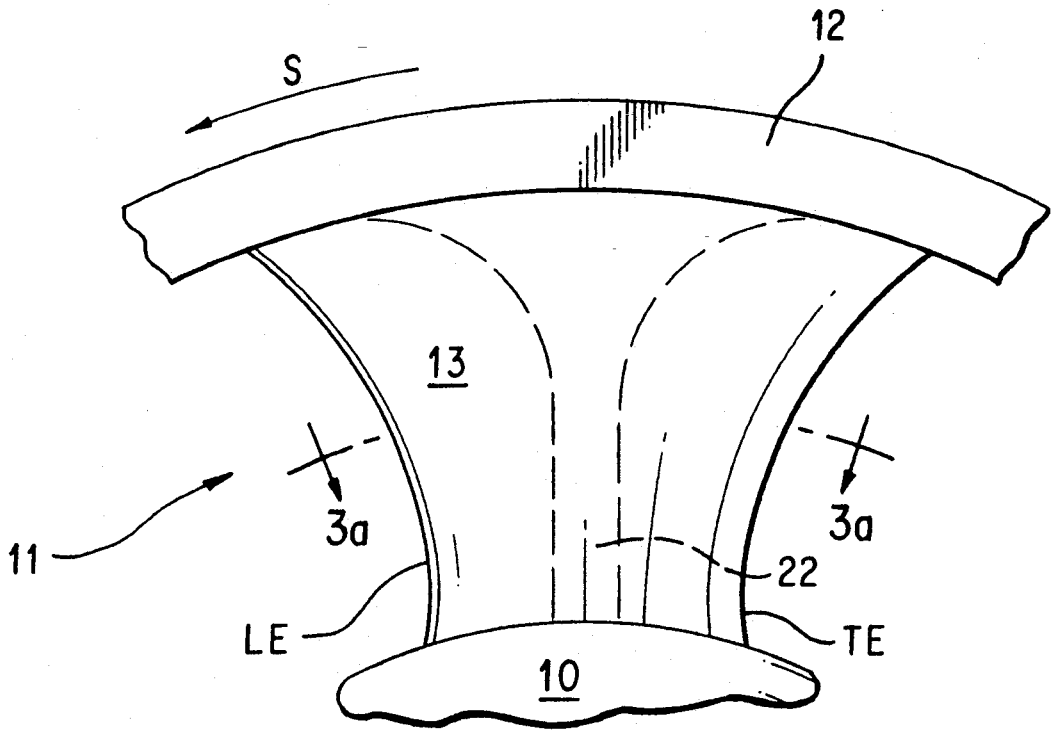
FIG. 3 is an elevational view of the third embodiment of the propeller according the present invention, in which an interior spar is situated interior of the limp fabric.
Figure 3A:
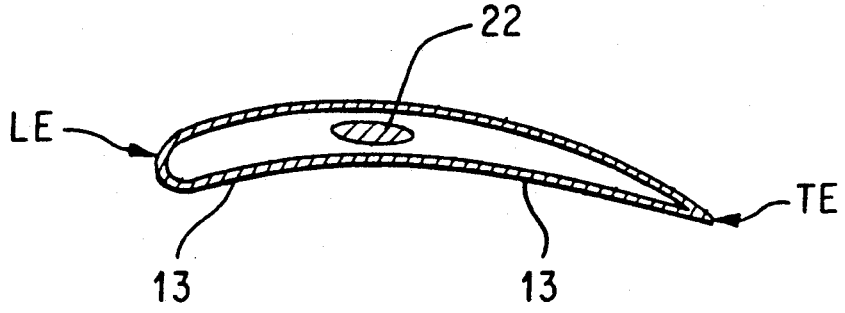
FIG. 3*a* is a cross-sectional view taken along line 3*a*—3*a* of FIG. 3, showing the cross-section of the propeller blade.

The third embodiment according to the present invention, as illustrated in FIG. 3, is similar to the second embodiment, in that, a spar is used to support the ring. In the third embodiment, only a single, centrally located spar 22 extends radially from the hub 10 to the ring 12, through about the central portion of the propeller blade 11. The limp fabric surrounds the spar as shown better in FIG. 3*a*. Again, since the spar supports the ring, the ring can be segmented at the trailing and the leading edges of each of the propeller blade tip substantially similar to the ring segment 12*a* of the fourth embodiment. In this instance, there will o be a plurality of ring segments rather than a circular ring 12. However, since only a single spar is used, if the ring is segmented, the spar would be subjected to high torque loads. Moreover, the fabric may be attached to the ring as shown in FIGS. 7 and 8. This embodiment may optionally include a viscoelastic material as the flexible matrix material and/or a coating material, as the operational requirements dictate.

FOURTH EMBODIMENT

Figure 4:
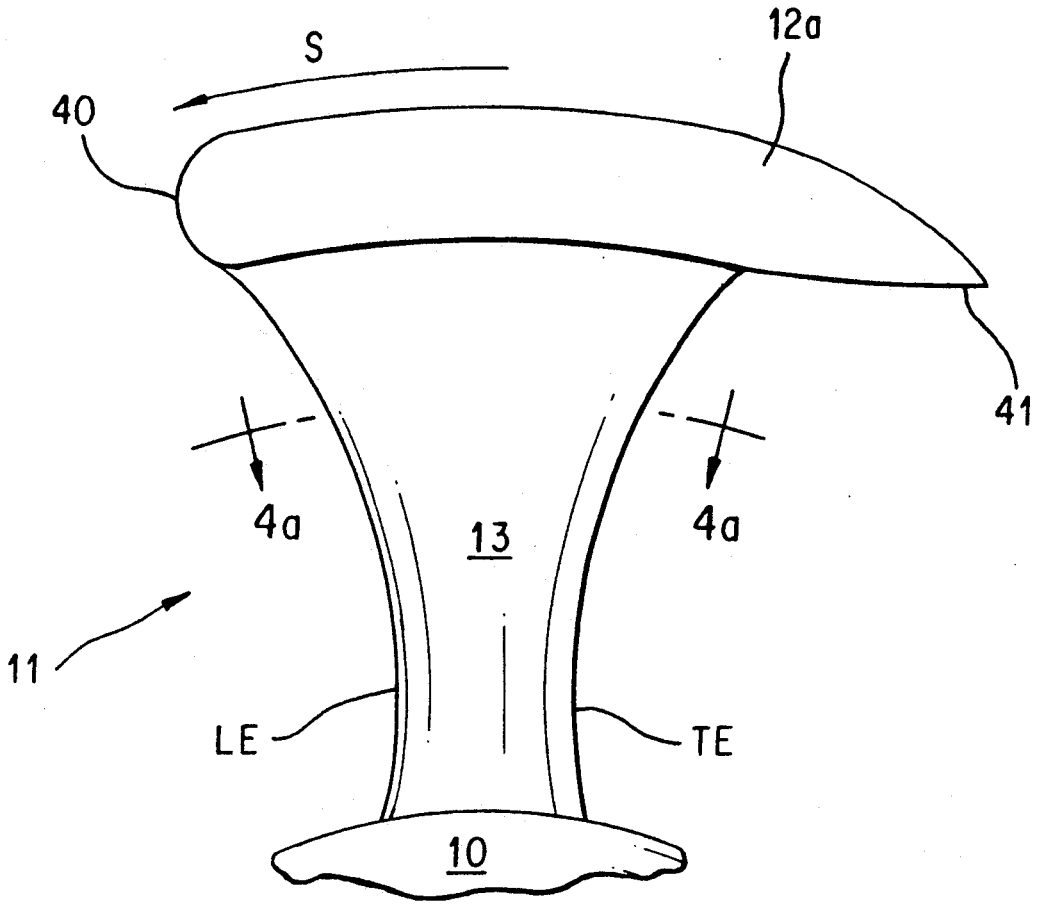
FIG. 4 is an elevational view of the fourth embodiment of the propeller according the present invention, which is similar to the first embodiment, except that the ring is segmented rather than being a continuous circular ring.
Figure 4A:
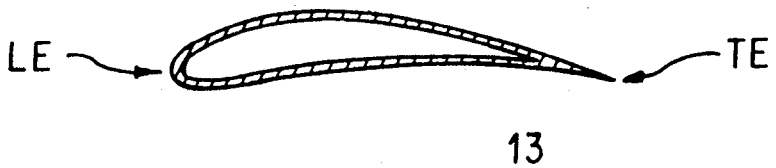
FIG. 4*a* is a cross-sectional view taken along line 4*a*—4*a* of FIG. 4, showing the cross-section of the propeller blade.

The fourth embodiment according to the present invention, as illustrated in FIG. 4, is similar to the first embodiment, except that the support ring is segmented in this embodiment. No spar or high density or localized mass is contemplated in this embodiment, in contrast to the first embodiment. The ring is segmented with a round smooth leading edge tip 40 forming to a pointed tail 41 toward the trailing edge TE. In this embodiment, the limp fabric is stretched and tensioned around the ring segment 12*a* and the blade develops its shape via the centripetal force during rotation. Due to the fact that a high tip velocity is required to attain the necessary centripetal force, this embodiment is preferably used where a high rotational propeller speed is required. However, it is to be noted that a higher the tip velocity, the higher the acoustic radiation becomes. Again, the fabric may be attached to the ring as shown in FIGS. 7 and 8. The embodiment may optionally include a viscoelastic material as the flexible matrix material and/or a coating material, as the operational requirements dictate.

Figure 4B:
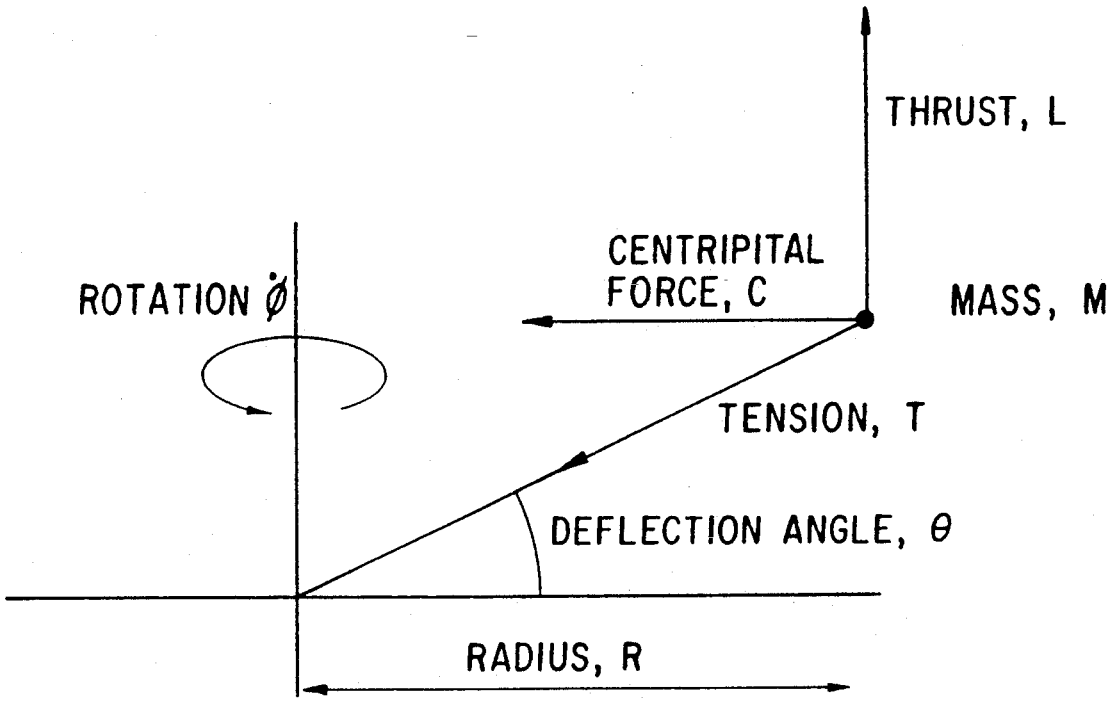
FIG. 4*b* is a schematic diagram of forces involved in the propeller blade.

FIG. 4*b*, shows a simplified schematic diagram of the forces involved in the fourth embodiment. FIG. 4*b* shows the radius R of the propeller blade along the X-axis and the rotation $R\phi$ of the blade around the Y-axis. The deflection angle $\theta$ is the propeller blade deflection caused by loads. The centripetal force C points inward toward (in the X-direction) the axis of rotation. The thrust or load L arises from the lift produced by the propeller. The tension T is the net force placed on the limp fabric during rotation.

The following equations shows the relationship between C, L, M, T, $\dot{\phi}$ and $\theta$:

Tip Velocity $= R\dot{\phi}$ and thus $C = MR\dot{\phi}$;

$L = T \sin\theta$;

$C = T \cos\theta$; and thus $T = C/\cos\theta$; Substituting T with $C/\cos\theta$ in $L = T \sin\theta$ above, $L = C \sin\theta/\cos\theta$; Substituting C with $MR\phi$, $L = MR\dot{\phi} \sin\theta/\cos\theta = MR\dot{\phi} \tan\theta$ $\tan\theta = L/MR\dot{\phi}$.

As illustrated in the above equations, the Tan of the deflection angle $\theta$ is inverse proportional to the tip velocity or the centripetal force C. Thus, in order to keep the deflection angle $\theta$ as small as possible, the tip velocity and/or the tip mass must be large. Since it is desirable to keep the weight as small as possible, it is desirable to attain a high tip velocity $R\dot{\phi}$. However, it is also known that a higher the tip velocity, the higher the acoustic radiation becomes.

FIFTH EMBODIMENT

Figure 5:
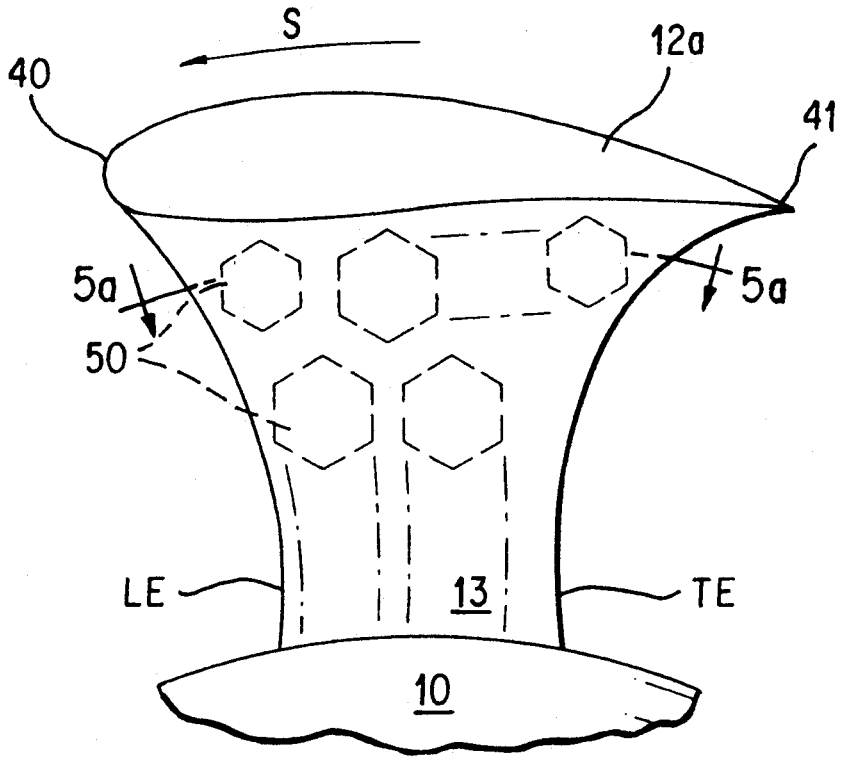
FIG. 5 is an elevational view of the fifth embodiment of the propeller according the present invention, which is similar to the fourth embodiment, except that inner stiff segments are situated interior of the limp fabric.

The fifth embodiment according to the present invention, as illustrated in FIG. 5, is similar to the fourth embodiment, except that the propeller blade has inner stiff segments to reduce the deflection angle without increasing the tip velocity or the tip mass. In this embodiment, the limp fabric is attached to the stiff inner segments 50 to produce kerf-like inner supports. The stiff inner segments, each preferably have hexagonal-like cross-section and consists of any of or a combination of the following materials:

a) a hollow or solid, light material, possibly composite construction with a stiff matrix material,
b) a dense material, possibly tungsten, or
c) a viscoelastic-like material Materials a) above are desirable for reducing weight while providing a means of transforming the lift into tension of the fabric. Materials b) are preferable for reducing the blade surface flexural wave speed. Materials c) are preferable for enhancing the damping efficiency.

Figure 5A:
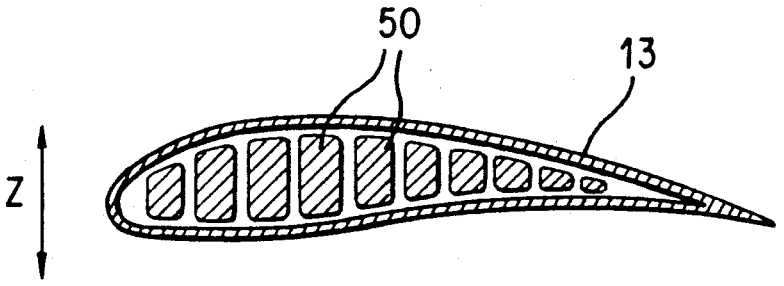
FIG. 5*a* is a cross-sectional view taken along line 5*a*—5*a* of FIG. 5, showing the cross-section of the propeller blade.

The stiff segments need not be attached to the outer skin, although they may be. The segments touch one another in much the same fashion as child's playing blocks touch each other when they are put into a sock, similar to the manner shown in FIG. 5*b*. The blocks add a certain amount of bending rigidity to the otherwise limp sock. However, the resistance to bending is provided by the sock itself in resisting extensional stresses in the plane of the sock. The extensional segments may or may not have viscoelastic material between them and/or between the segments and the outer fabric skin. The segments are not of identical shape, but are fashioned geometrically so that they accommodate the intended shape of the sail-blade under load in this embodiment. This is illustrated in FIG. 5*a* which shows each segment having a different height along the chord of the sail blade. This would also be true along the span of the sail-blade. In FIG. 5*a*, the segments are depicted as not touching, whereas in FIG. 5*b* they are touching. The spacing between each segment may be filled with a viscoelastic material to enhance damping. Again, the fabric may be attached to the ring as shown in FIGS. 7 and 8.

Figure 5B:
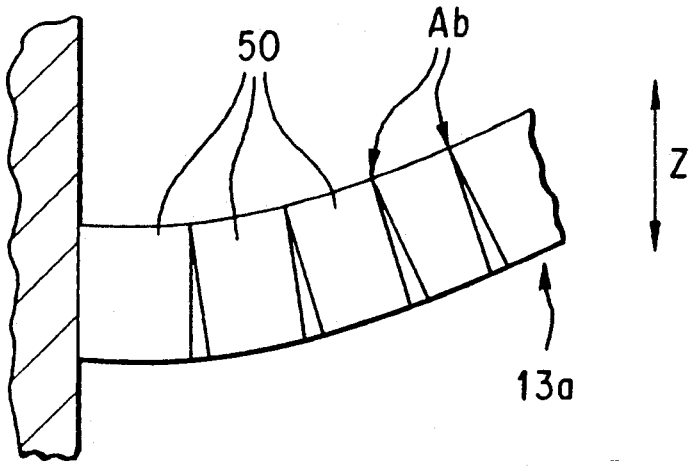
FIG. 5*b* is a schematic diagram depicting how the inner stiff segments of FIG. 5 reduce the deflection angle $\theta$ in FIG. 4*b* without requiring high tip velocities.

FIG. 5*b* illustrates how the inner kerfing-like stiff segments 50 reduce the deflection angle $\theta$ of the propeller blade of the fifth embodiment without requiring a high tip velocity. Specifically, when the propeller blade is deflected in the direction of the arrows Z shown in FIGS. 5*a* and 5*b*, the inner stiff segments 50 abut against each other as illustrated by Ab in FIG. 5*b* and prevent the blade from deflecting further. In short, the inner stiff segments enable the limp fabric to flex in the direction of the rotation S, but limit the deflection in the direction generally perpendicular to the surface of the blade.

SIXTH EMBODIMENT

Figure 6:
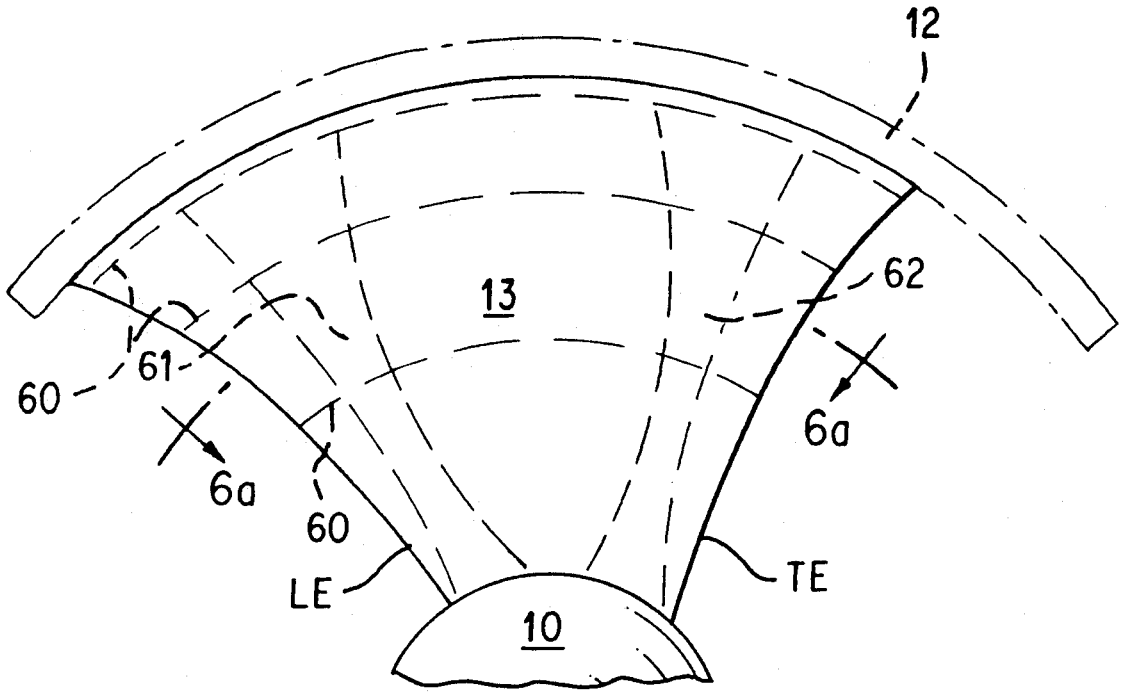
FIG. 6 shows an elevational view of the sixth embodiment of the propeller according the present invention, which is shown with flat inner supports and spars, with the outer fabric which covers the inner support structure, and the optional ring shown in phantom.

The sixth embodiment according to the present invention, as illustrated in FIG. 6, is similar to the second embodiment, except that a plurality of flat inner supports 60 are placed between a pair of spaced apart spars 61, 62. In this embodiment, the flexible fabric 13 of limp high tensile strength fiber is stretched between and completely covers the inner supports 60 (in a fashion similar to the manner in which early airplane wings were fabricated). Specifically, the pair of spars which are spaced apart extend radially from the hub. The inner supports 60 are spaced apart in the radial direction and the fabric is stretched or wrapped around the inner supports. This embodiment may optionally include a viscoelastic material as the flexible matrix material and/or a coating material, as the operational requirements dictate.

Figure 6A:
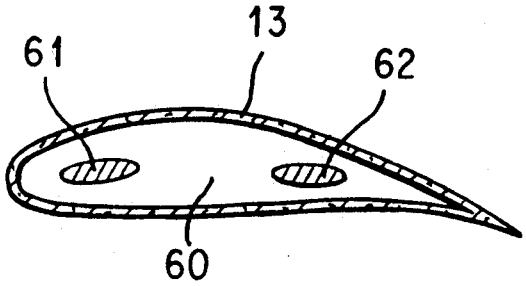
FIG. 6*a* is a cross-sectional view taken along line 6*a*—6*a* of FIG. 6, showing the cross-section of the propeller blade and the shape of the flat inner support.

The outer supporting ring is optional since the spars support the fabric. If the outer supporting ring is used, the fabric may be attached to the ring as shown in FIGS. 7 and 8. FIGS. 6 and 6*a* are shown with the spars contained interior of the inner supports. Alternatively, the spars could be part of the leading and trailing edges as shown in the second embodiment (FIG. 2), with the inner supports 60 attached to the spars. Alternative, the spars could be omitted altogether if a full circular support ring 12 is used and attached to fabric in the manner similar to the first embodiment.

Given the disclosure of the present invention, one versed in the art would readily appreciate the fact that there can be many modifications of the present invention not specifically depicted and described, but that are well within the scope and spirit of the disclosure set forth herein. Accordingly, all expedient modifications readily attainable by one versed in the art from the disclosure set forth herein that are within the scope and essence of the present invention, are to be included as further embodiments of the present invention.

What is claimed is:

1. A limp propeller comprising:

a central hub having an axis of rotation and adapted for mounting to a rotatable shaft;

a circular support ring; and a plurality of circumferentially spaced apart propeller blades extending radially from said central hub, each of said propeller blades having one end connected to said central hub and a tip thereof connected to said circular support ring, and each of said propeller blades comprising:

a leading edge and a trailing edge each of which extends substantially radially from said hub to said tip of said blades, and a first face and a second face each of which extends between said leading and trailing edges;

a flexible fabric of high tensile strength material, said fabric forming said leading and trailing edges and said first and second faces;

first and second support spars extending radially between said hub and said circular support ring, said first space being circumferentially spaced apart from said second spar, whereby said flexible fabric surrounds said first and second spars; and at least one flat inner support spaced radially from said hub and extending between said first and second spars and attached thereto, whereby said flexible fabric wraps peripherally around said at least one inner support.

2. A limp propeller according to claim 1, wherein said flexible fabric is impregnated with viscoelastic material.

3. A limp propeller according to claim 1, wherein said leading edge is formed by said first spar and said trailing edge is formed by said second spar, wherein said flexible fabric wraps around said leading and trailing edges.

4. A limp propeller according to claim 1, wherein each of said spars runs through said at least one flat inner support.

5. A limp propeller according to claim 4, wherein each of said propeller blades further comprises a plurality of said inner supports which are spaced apart in the radial direction and each of said spars run through said inner supports, wherein said fabric wraps peripherally around said inner supports.

6. A limp propeller according to claim 1, wherein each of said propeller blades further comprises a plurality of inner supports which are spaced apart in the radial direction, whereby said fabric wraps peripherally around said inner supports.

7. A limp propeller comprising:

a central hub having an axis of rotation and adapted for mounting to a rotatable shaft;

a plurality of circumferentially spaced apart propeller blades extending radially from said central hub, each of said propeller blades comprising:

a pair of circumferentially spaced apart spars extending radially from said central hub;

at least one flat inner support spaced radially from said central hub and extending between said spars and attached thereto; and a flexible fabric of high tensile strength material having one end connected to said central hub and being wrapped peripherally around said at least one flat inner support and said spars, said fabric being impregnated with viscoelastic material.

8. A limp propeller according to claim 7, wherein each of said spars runs through said flat inner support.

9. A limp propeller according to claim 8, wherein each of said propeller blades further comprises a plurality of said inner supports which are spaced apart in the radial direction and each of said spars run through said inner supports, whereby said fabric wraps peripherally around said inner supports.

10. A limp propeller according to claim 7 further comprising a circular support ring connected to an outer peripheral tip of each of said plurality of circumferentially spaced apart propeller blades.

* * * * *